US012582889B2

(12) United States Patent
Hutchinson

(10) Patent No.: US 12,582,889 B2
(45) Date of Patent: Mar. 24, 2026

(54) GOLF DISC RETAINER

(71) Applicant: Gotta Go Gotta Throw Incorporated, Golden Valley, MN (US)

(72) Inventor: Charles H. Hutchinson, Minnetonka, MN (US)

(73) Assignee: Gotta Go Gotta Throw Incorporated, Golden Valley, MN (US)

( * ) Notice: Subject to any disclaimer, the term of this patent is extended or adjusted under 35 U.S.C. 154(b) by 44 days.

(21) Appl. No.: 18/139,527

(22) Filed: Apr. 26, 2023

(65) Prior Publication Data

US 2023/0338811 A1 Oct. 26, 2023

Related U.S. Application Data

(60) Provisional application No. 63/335,001, filed on Apr. 26, 2022.

(51) Int. Cl.

| | |
|---|---|
| ***A63B 71/00*** | (2006.01) |
| ***A45C 13/02*** | (2006.01) |
| ***A63B 65/10*** | (2006.01) |
| *A63B 67/06* | (2006.01) |

(52) U.S. Cl.

CPC ..... *A63B 71/0036* (2013.01); *A45C 13/02* (2013.01); *A45C 2013/026* (2013.01); *A63B 65/10* (2013.01); *A63B 67/06* (2013.01)

(58) Field of Classification Search

CPC ..... A45C 13/02; A63B 71/0036; A63B 65/10; A63B 60/62; A63B 55/00

USPC ..... 206/315.1, 315.2, 315.3, 315.4, 615.6; 211/70.1, 70.2

See application file for complete search history.

(56) References Cited

U.S. PATENT DOCUMENTS 6,202,840 B1 * 3/2001 Chang ..... A63B 55/00 150/159

6,536,588 B1 * 3/2003 Kyrwood ..... A63B 55/408 206/315.6

(Continued)

OTHER PUBLICATIONS

Dynamic Discs, Dynamic Discs Trooper Disc Golf Backpack, Available at: Amazon.com <https://www.amazon.com/Dynamic-Backpack-Capacity-Introductory-Lightweight/dp/B07S58FFWB/ref=sr_1_1_sspa?crid=28XU12ZLP69FF&keywords=disk%2Bgolf%2Bbag&qid=1682446025&sprefix=disk%2Bgolf%2Bbag%2Caps%2C101&sr=8-1-spons&spLa=ZW5jcnlwdGVkUXVhbGlmaWVyPUExTUM1OUJST003WTYMZW5jcnlwdGVkSWQ9QTAwNTIvQMzUyWIJaV0dEN1FaWVJSJmVuY3J5cHRIZEFkSWQ9QTEwMzo4NzQxV0Q4WldVRVoyWVZBJndpZGdldE5hbWU9c3BfYXRmJmFjdGlvbj1jbGlja1jlZGlyZWN0jmRvTm90TG9nQ2xpY2s9dHJ1ZQ&th=1&psc=1 > [Retrieved Apr. 25, 2003] 7 pages.

*Primary Examiner* — Rafael A Ortiz

(74) *Attorney, Agent, or Firm* — Dicke, Billig & Czaja, PLLC

(57) ABSTRACT

One example provides a golf disc retainer for use with a storage container, the golf disc retainer including a body extending longitudinally between opposing first and second ends and laterally between opposing first and second sides, the body comprising an elastic material and including a central base portion extending between the first and second ends, and a pair of opposing side rails extending between the first and second ends along opposing longitudinal sides of the central base portion. Upper surfaces of the central base portion and the pair of opposing side rails together define a wedge-shaped space extending between the first and second ends, the wedge-shaped space to receive golf discs positioned vertically to the upper surfaces and perpendicularly to the opposing side rails with the elastic material of the upper surfaces of the central base portion and the opposing side (Continued)

rails to engage and conform about respective arc segments along a circumferential rim of each golf disc.

18 Claims, 6 Drawing Sheets

(56) References Cited

U.S. PATENT DOCUMENTS

| | | | | |
|---|---|---|---|---|
| 6,966,439 | B2 * | 11/2005 | Weleczki | A45C 7/0077 206/315.6 |
| 7,874,563 | B2 | 1/2011 | Mims | |
| 7,997,594 | B1 | 8/2011 | Mortazavi et al. | |
| 7,997,595 | B1 | 8/2011 | Pope | |
| 8,746,711 | B1 | 6/2014 | Jarma | |
| 2002/0105156 | A1 | 8/2002 | Glidden | |
| 2003/0192797 | A1 * | 10/2003 | Man | A63B 55/406 206/315.6 |
| 2004/0245133 | A1 * | 12/2004 | Heidenreich | A63B 55/408 206/315.6 |
| 2009/0145787 | A1 * | 6/2009 | Grander | A63B 55/50 206/315.6 |
| 2019/0009152 | A1 * | 1/2019 | Klevana | A63B 55/406 |

* cited by examiner

GOLF DISC RETAINER

CROSS REFERENCE TO RELATED APPLICATIONS

This Non-Provisional patent application claims the benefit of the filing date of U.S. Provisional Patent Application Ser. No. 63/335,001, filed Apr. 26, 2022, entitled "GOLF DISC RETAINER", which is herein incorporated by reference.

BACKGROUND

Disc golf is rapidly growing as a sport and is now played in approximately 40 countries worldwide. As its name implies, disc golf is similar in nature to traditional golf, but rather than using clubs to strike a golf ball into a series of holes, a player throws a flying disc, referred to as a golf disc, at a series of targets, typically referred to as baskets. Analogous to the various types of clubs employed in in traditional golf (e.g., drivers, various irons, pitches wedges, and putters), there are different types of golf discs that are used in different playing situations. The basic types of golf discs include putters, midrange discs, control/fairway drivers, and maximum distance drivers. When playing a round of disc golf, players, especially experienced players, often carry a large number of discs (e.g., discs of different types, sizes, weights, material composition, and colors). As a result, players often employ some type of carrier (e.g., a duffle bag or cart) to carry their golf discs and, sometimes, other accessories (e.g., water, sunscreen, towels).

SUMMARY

Examples of the present disclosure provide a golf disc retainer which receives and self-adjusts to the diameter and rim profile of each individual golf disc, and a storage container, such as a duffle, including such retainer. In examples, at least portions of the golf disc retainer comprise an elastic material which self-adjusts the differing diameters and rim profiles of individual discs.

One example provides a golf disc retainer for use with a storage container, the golf disc retainer including a body extending longitudinally between opposing first and second ends and laterally between first and second sides. The body comprises an elastic material and includes a central base portion extending between the first and second ends, and a pair of opposing side rails extending along opposing longitudinal sides of the central base portion between the first and second ends. The upper surfaces of the central base portion and the pair of opposing side rails together form an upper surface of the body and define a wedge-shaped space extending between the first and second ends, the wedge-shaped space to receive golf discs of varying diameters and rim profiles and positioned vertically to the upper surface of the body and perpendicularly relative to the opposing side rails such that the elastic material of the upper surfaces of the central base portion and the opposing side rails each engage and conform about respective arc segments along a circumferential rim of each golf disc.

One example provides a storage container defining a storage compartment and including a golf disc retainer, in accordance with the present disclosure, disposed within the storage compartment for storing golf discs.

Additional and/or alternative features and aspects of examples of the present technology will become apparent from the following description and the accompanying drawings.

DETAILED DESCRIPTION

Figure 1A:
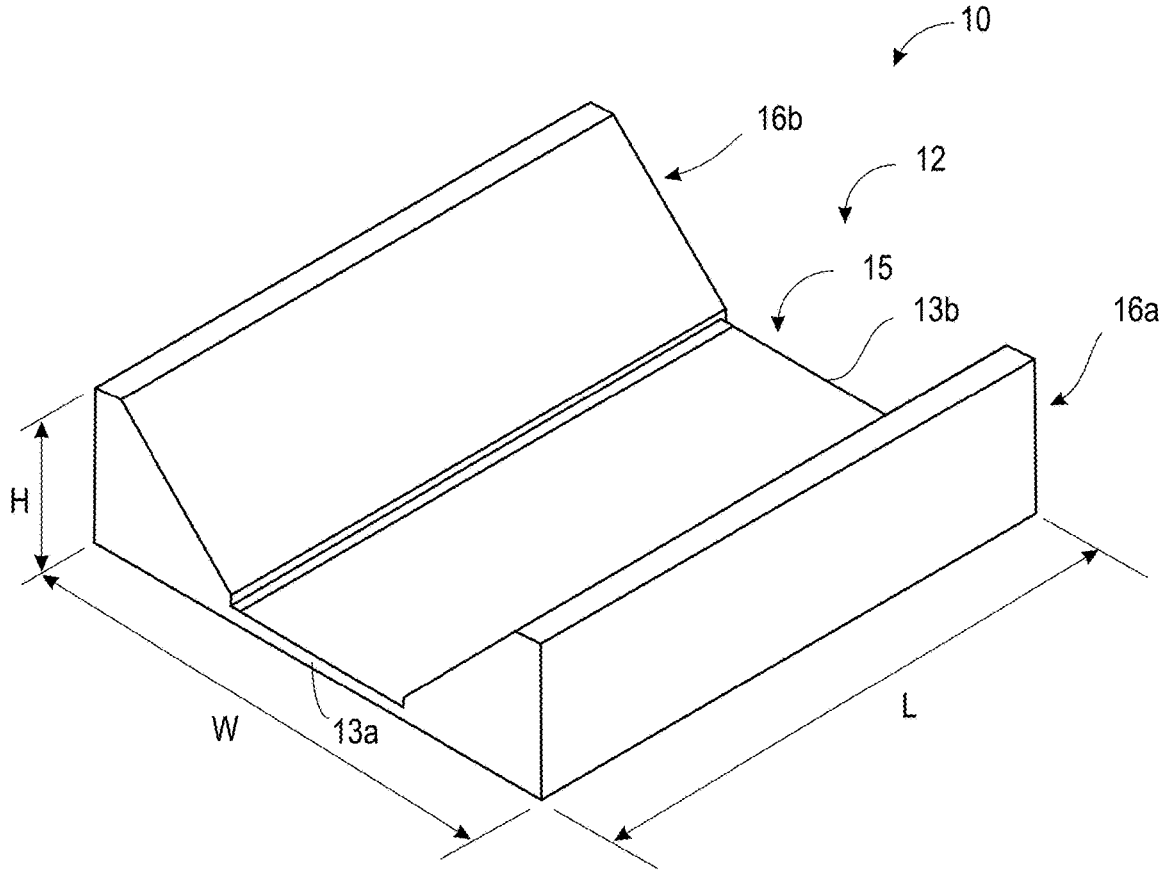
FIG. 1A is a perspective view illustrating a golf disc retainer, according to one example of the present disclosure.

In the following Detailed Description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that features of the various examples described herein may be combined, in part or whole, with each other, unless specifically noted otherwise. It is also to be understood that other examples may be utilized and structural or logical changes may be made without departing from the scope of the present disclosure. The following detailed description, therefore, is not to be taken in a limiting sense.

As mentioned earlier, when playing a round of disc golf, players, particularly experienced players, often carry a large number of discs. Such discs may include multiple discs of each type, such as multiple putters, midrange discs, control drivers, and maximum distance drivers, where the multiple discs of each type may have different properties, such as different colors, different weights, different dimensions (e.g., diameter, rim height, rim width, rim profile), different material compositions (e.g., different plastic materials), and different flight properties (e.g., distance, stability), for example. As a result, players often employ some type of storage container, such as a cart mountable container or a shoulder carried duffle bag or back pack, which can be readily transported by a player during a round of disc golf.

With this in mind, various storage containers have been developed for storing and carrying golf discs, with the most common being a fabric duffle bag that can be carried on the shoulder and/or as a backpack. In other examples, pull along carts have also been developed which include integral storage containers, or to which external storage containers, such as duffle bags or backpacks, may be selectively mounted. Such storage containers, including duffle bags, typically define an interior volume or storage space accessible via a cover or flap that is selectively operable between a closed position and an open position, wherein the flap may secured in the closed position using any number of suitable securing mechanisms such as zippers or a hook and loop system, for example.

In some cases, the interior volume is simply an open space in which discs may be placed. However, in such case, when transporting the container, such as a player carrying a duffle bag or pulling the container on a cart, or even when transporting the container in a vehicle, the golf discs may be jostled about and bump and/or rub against one another and potentially damage the discs (e.g., cause nicks and abrasions). Such damage may adversely impact the use (e.g., sharp edges causing discomfort when throwing) and/or performance of the disc (e.g., adversely impact disc aerodynamics).

With this in mind, the interior storage spaces of some disc containers, including some duffle bags, have been configured with stabilizing mechanisms designed to prevent movement of golf discs stored therein when the container is transported. In some cases, such stabilizing mechanism includes a pair of opposing longitudinally extending internal flexible side panels between which the golf discs are to be inserted such that radially opposing rim portions of the discs are engaged by the opposing side panels. Such arrangement is designed to secure the golf disc between the panels to prevent movement of the discs in both the lateral and longitudinal dimension of the storage space. However, in practice, larger diameter discs push the opposing side panels apart such that smaller diameter discs are not engaged by the opposing side panels, with the result being that smaller diameter discs are left to move about freely (laterally, longitudinally, and vertically) to bump and rub against adjacent discs. Additionally, a bottom portion of the rim of each disc rests on the bottom side of the storage compartment (including the larger diameter discs) and may be subject to impacts when the bag is placed (or dropped) on the ground (or other surfaces).

In other examples, the stabilizing mechanism may comprise a number of slots into which individual discs may be inserted. In some cases, each slot comprises respective sets of fingers extending perpendicularly toward one another from the opposing side walls of the storage compartment. While such slots may limit movement of the golf discs in the longitudinal dimension of the storage compartment, lateral movement of smaller diameter discs is still an issue, as is the resting of a portions of the rim of the golf discs on the bottom of the storage compartment.

Figure 1B:
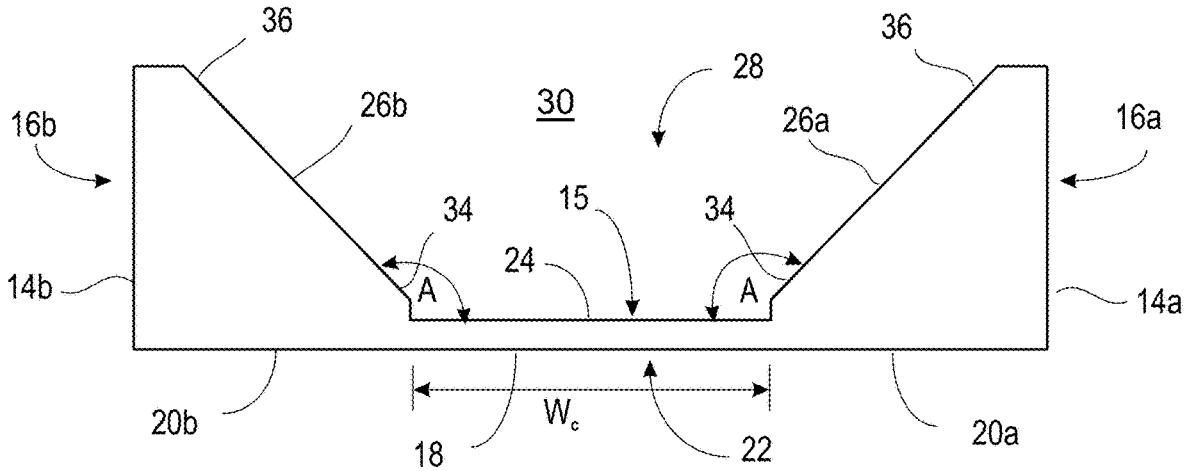
FIG. 1B is a cross-sectional view illustrating a golf disc retainer, according to one example of the present disclosure.

FIGS. 1A and 1B respectively illustrate perspective and lateral cross-sectional views of a golf disc retainer 10 for use with a storage container, according to one example of the present disclosure. As will be described in greater detail herein, golf disc retainer 10 is configured to be disposed within a storage compartment of a storage container, such as within a storage compartment of a portable fabric duffle bag, for example (such as illustrated generally by FIG. 2), and is configured to receive and engage golf discs of varying diameters at multiple points about their circumferences so as to prevent both lateral and longitudinal movement of the golf discs within the storage compartment, and, thereby, reduce the potential for damage to the golf discs during transport. In one example, as will be described in greater detail below, golf disc retainer 10 is configured to engage golf discs of varying diameters along at least three arc segments of the disc circumferences.

In one example, golf disc retainer 10 includes a contiguous body 12 (i.e., formed from a single piece of material) having a length, L, extending in a longitudinal direction between opposing ends 13*a* and 13*b*, a width, W, extending in a lateral direction between opposing sides 14*a* and 14*b*, and a height, H. In one example, as illustrated, body 12 is formed as a tray. In one example, contiguous body 12 includes a central base portion 15 and a pair of opposing side rails 16*a* and 16*b* extending longitudinally on opposing longitudinal sides of central base portion 15. In one example, lower surface 18 of central base portion 15 and lower surfaces 20*a* and 20*b* of opposing side rails 16*a* and 16*b* together form a contiguously extending lower surface 22 of body 12, and upper surface 24 of central base portion 15 and upper surfaces 26*a* and 26*b* of opposing side rails 16*a* and 16*b* together form a contiguously extending upper surface 28 of body 12. Although described and illustrated herein as comprising a contiguous piece of material, in other examples, body 12 may be formed from multiple pieces, where such pieces may be formed from the same or from different materials.

In examples, body 12 is formed of an elastic material (e.g., a foam material), which is compressible to enable body 12 to receive and automatically self-adjust to differing diameters and rim profiles of different types and makes of golf discs (as illustrated and described in greater detail below). In one example, body 12 is formed of a closed-cell foam material. In one example, the closed cell foam material has a compressive strength at 25% (i.e., the force required to compress the foam by 25% of its thickness) of 21.2 (per ASTM D 357593 Suffix D standards), and a compression set (i.e., the percentage the material fails to recover to its original height when compressed to a specific deformation) of 10% (per ASTM D 357593 Suffix B standards).

In one example, as illustrated, lower surface 22 is a substantially planar. In one example, as illustrated, upper surface 24 of central base portion 15 is substantially planar, and upper surfaces 26*a* and 26*b* of side rails 16*a* and 16*b* are sloped upwardly and outwardly away from upper surface 24 of central base portion 15 so that upper surface 28 of body 12 forms a wedge-shaped space 30. As will be described in greater detail below, wedge-shaped space 30 enables golf disc retainer 10 to receive golf discs of varying diameters with upper surface 24 of central base portion 15 and upper surfaces 26*a* and 26*b* of opposing side rails 16*a* and 16*b* each to receive and engage a different arc segment along a circumference edge surface of each golf disc (e.g., see FIGS. 5 and 6 below).

In one example, as illustrated, upper surfaces 26*a* and 26*b* of side rails 16*a* and 16*b* are substantially planar and slope upwardly and outwardly away from upper surface 24 of central base portion 15 from a lower edge 32 to an upper edge 36. In one example, upper surfaces 26*a* and 26*b* of side rails 16*a* and 16*b* each slope upwardly and outwardly away from upper surface 24 of central base portion 15 at an angle, A. In examples, a width, Wc, of central base portion 15 and angle A are selected so as to enable golf discs having a range of diameters to be received within wedge-shaped space 30 with each of the upper surfaces 24, 26*a*, and 26*b* engaging a different arc segment of the circumferential edge of each golf disc. In one example, angle A is 135-degrees, W is 9-inches, and We is 3.5-inches. It is noted that other dimensions may be employed. In other examples, upper surfaces 24, 26*a*, and 26*b* may be non-planar surfaces (e.g., upper surfaces 26*a* and 26*b* may be curvilinear).

Figure 1C:
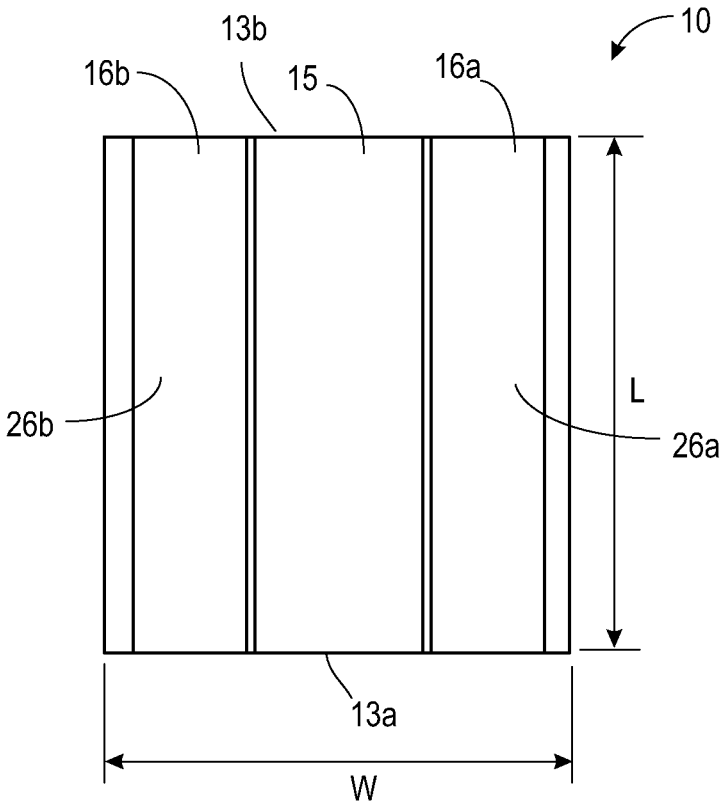
FIGS. 1C and 1D represent top and side views of a golf disc retainer, according to one example of the present disclosure.
Figure 1D:
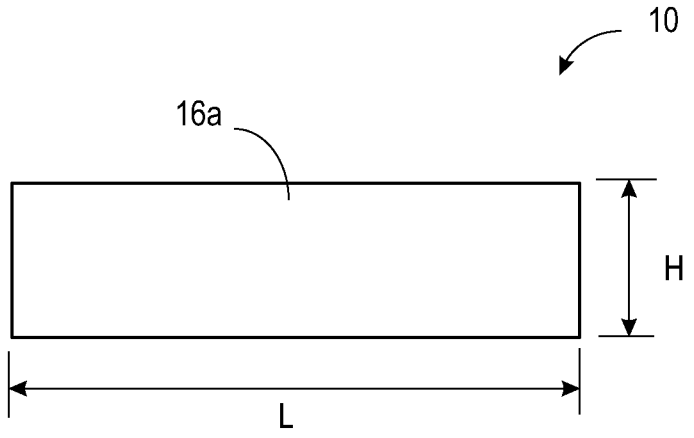

FIGS. 1C and 1D represent top and side views of a golf disc retainer 10 of FIGS. 1A and 1B, according to one example.

Figure 2:
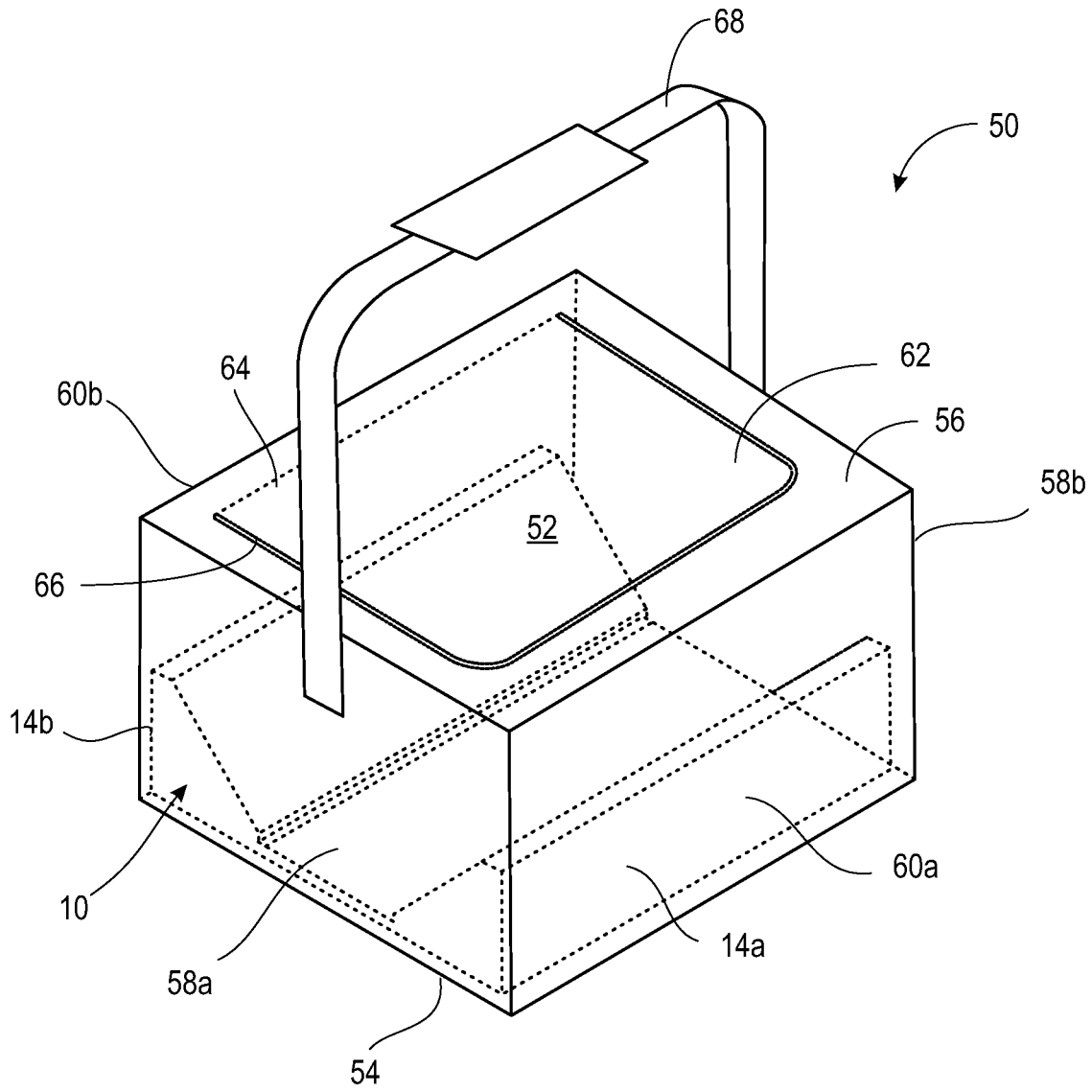
FIG. 2 is a perspective view generally illustrating a golf disc carrying container including a golf disc retainer, according to one example of the present disclosure.

FIG. 2 is a perspective view generally illustrating a golf disc storage container 50 defining an interior storage compartment 52 in which golf disc retainer 10 is disposed. In one example, storage container 50 includes a bottom side 54, an opposing top side 56, opposing ends panels 58*a* and 58*b*, and opposing longitudinal sides 60*a* and 60*b* which together define interior storage space or compartment 52. In one example, top side 56 includes a cover 62 that is operable between a closed position (as illustrated in FIG. 2) and an open position, such as along a hinge line 64 (e.g., a flexible seam) to provide access to interior storage compartment 52. In examples, cover 62 may be secured in the closed position using a closing mechanism 66, such as a zipper, hook and loop system, magnets, and snaps, for example. Any number of suitable closing mechanisms may be employed. In one example, container 50 includes a carrying strap 68. In examples, carrying strap 68 may comprise a shoulder strap (as illustrated) and/or may be configured to enable container 50 to be carried as a back pack.

Although not illustrated, it is noted that container 50 may be configured with any number of interior and/or exterior pockets for storage of various items, including exterior pockets for holding golf discs. In one example, storage container 50 comprises a water-resistant fabric duffle bag that may be configured to be carried as a shoulder bag and/or as a back pack. In examples, as will be illustrated in greater detail below, golf disc retainer 10 is formed of a material (e.g., closed cell foam) that can be cut to adjust the length, L, and width, W, so that the size of golf disc retainer 10 may be tailored by a user to fit within storage containers having varying dimensions (e.g., may be adapted to fit within an existing storage container or bag already owned by a disc golf player). Although illustrated primarily in terms of a tote or duffel bag, it is noted that golf disc retainer 10 may be employed in any number of suitable containers. Additionally, it is noted that, in addition to retaining golf discs, the elastic material of opposing longitudinal sides 14*a* and 14*b* formed by opposing side rails 16*a* and 16*b* serve as cushions to provide comfort to a user when container 50 is being carried, such as over-shoulder or as a back pack, for example.

Figure 6:
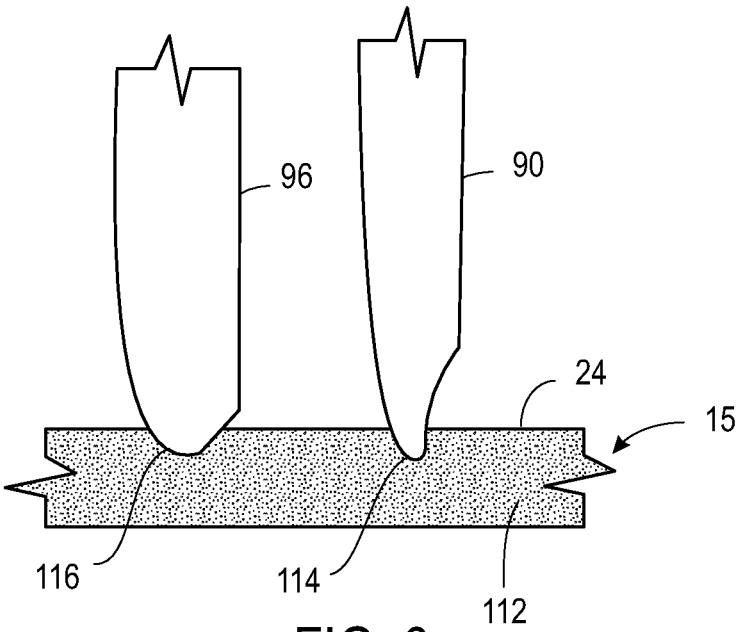
FIG. 6 is a cross-sectional illustrating portion of a golf disc retainer and portions of golf discs held therein, according to one example of the present disclosure.

As described above, golf disc retainer 10, via wedge-shaped space 30 and upper surfaces 24, 26*a*, and 26*b*, is able to receive an automatically self-conform to golf discs of varying diameters and varying rim profiles (e.g., see FIG. 6).

Figure 3:
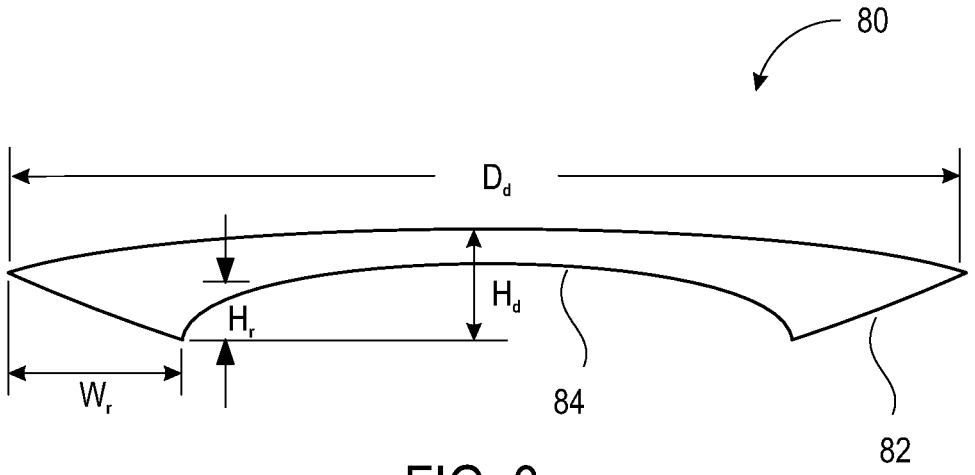
FIG. 3 is a cross-sectional view generally illustrating a golf disc, according to one example.
Figure 4A:
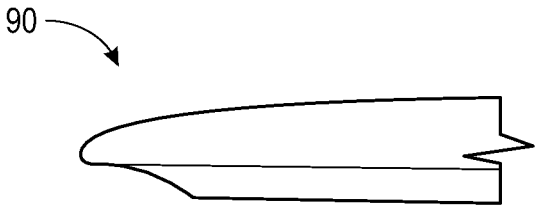
FIGS. 4A-4D generally illustrate generally illustrate rim profiles of different types of golf discs, according to one example.
Figure 4B:
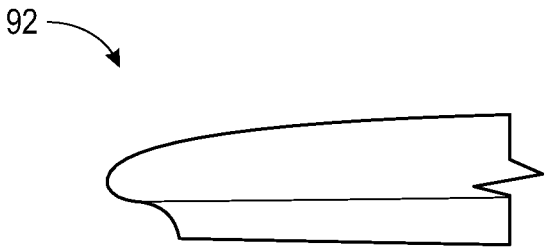
Figure 4C:
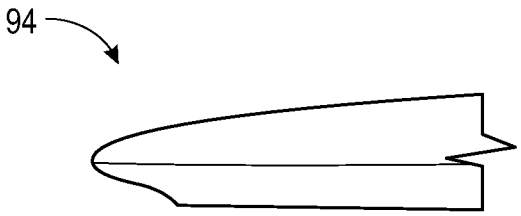
Figure 4D:
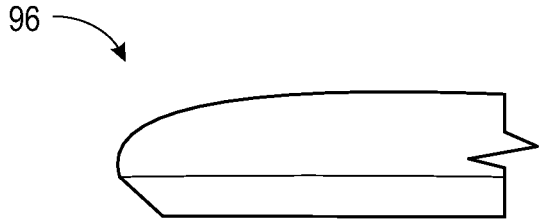

FIG. 3 generally illustrates an example cross-sectional view of a golf disc 80. As illustrated, golf disc 80 includes a rim 82 disposed about a perimeter of a flight plate 84. Golf disc 80 has an overall diameter, $D_d$, and an overall height, $H_d$. Rim 82 has a rim width, $W_r$, and a rim height, Hr. The Professional Disc Golf Association (PDGA) provides technical standards for golf disc construction. For example, the diameter, $D_d$, must not be less than 21 cm or greater than 30 cm (with most golf discs typically being in the range of 21 to 24 cm). Additionally, a disc's weight cannot exceed 8.3 grams per cm of the disc's diameter, $D_d$, and cannot exceed a maximum weight of 200 grams.

The diameters, weights, and rim profiles typically vary depending on the type of golf disc. For example, faster discs typically have less overall height, $H_d$, with distance drivers having an average height of 1.7 cm, and putters having an average height of 2.1 centimeters. Also, faster discs typically have a greater rim width, $W_r$, and a narrower/sharper rim profile than slower discs such that faster discs, while providing the potential to achieve greater distances, typically provide less control (stability) than slower discs. In general, the greater the rim width, $W_r$, and the thinner the rim profile, the faster the disc but the more difficult the disc is to control.

FIGS. 4A, 4B, 4C, and 4D, respectively illustrate example rim profiles of a maximum distance driver 90, a fairway driver 92, a midrange disc 94, and a putter 96. As illustrated, the rim profiles transition from being thicker and having more rounded edges to being thinner and having sharper edges as the speed of the discs increase and control decreases.

Figure 5:
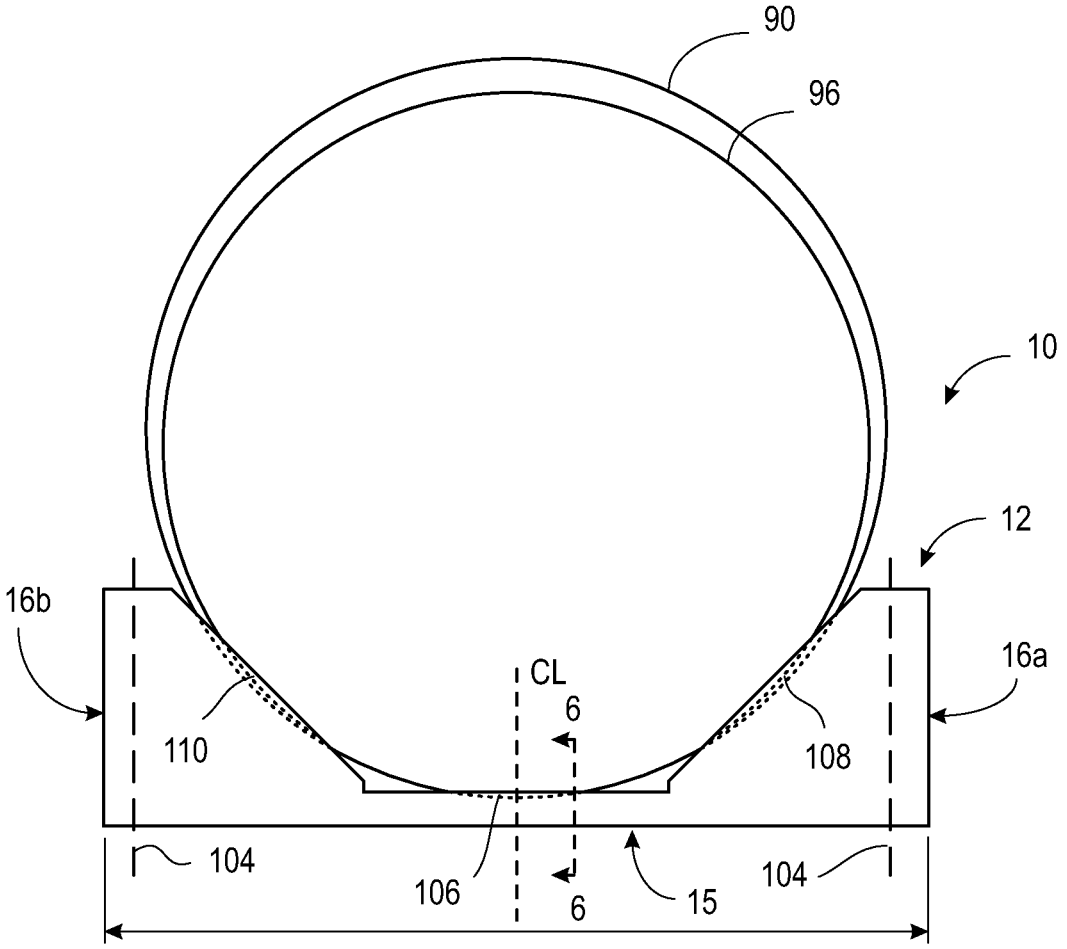
FIG. 5 generally illustrates an end view of a golf disc retainer holding golf discs, according to one example of the present disclosure.

FIG. 5 is an end view of golf disc retainer 10 having golf discs disposed and retained therein, such as maximum distance driver 90 (see FIG. 4A) and putter 96 (see FIG. 4D), where putter 96 has a smaller diameter than that of maximum distance driver 90, and each having different rim profiles. In examples, wedge shaped space 30 formed by upper surfaces 24, 26*a*, and 26*b* of central base portion 15 and opposing side rails 16*a* and 16*b* substantially centers golf discs 90 and 96 along a longitudinal centerline, CL, of body 12. In one example, as described above, the width, W, of body 12 can be adjusted by removing portions of each of the opposing side rails 16*a* and 16*b*, such as indicated by the "cut lines" at 104.

In examples, body 12 of golf disc retainer 10 comprises a deformable elastic material that compresses when a golf disc is disposed thereon (e.g., from force applied to the golf disc by a user or from the weight of the golf disc acting over time), such that portions of the rims of golf discs placed in wedge-shaped space 30, such as golf discs 90 and 96, "sink" partially into the upper surfaces 24, 26*a*, and 26*b* of central base portion 15 and opposing side rails 16*a* and 16*b*. In examples, as the rims of golf discs, such as maximum distance driver 90 and putter 96, sink into the elastic material of body 12, the elastic material receives and conforms to the rim profiles thereof (see FIG. 6 below).

According to one example, as illustrated, each golf disc 90 and 96 contacts upper surface 28 of golf disc retainer 10 at upper surface 24 of central base portion 15, and at upper surfaces 26*a* and 26*b* of opposing side rails 16*a* and 16*b*. At each contact location, the rims of golf discs 90 and 96 sink into the elastic material such that three different arc segments about the circumference of each golf disc 90 and 96 are received and retained by body 12 so that discs 90 and 96 are not able to move laterally (i.e., in the width direction of body 12) and longitudinally (i.e., in the length direction of body 12). The arc lengths retained within the elastic material of body 12 are indicated by the dashed lines at 106, 108, and 110.

FIG. 6 is a cross-sectional view generally illustrating portions of the rims of golf discs 90 and 96 of FIG. 5 being "sunk into" upper surface 24 of central base portion 15 with elastic material 112 of central base portion respectively conformed to the rim profiles of maximum distance driver 90 and putter 96 as indicated at 114 and 116.

Figure 7A:
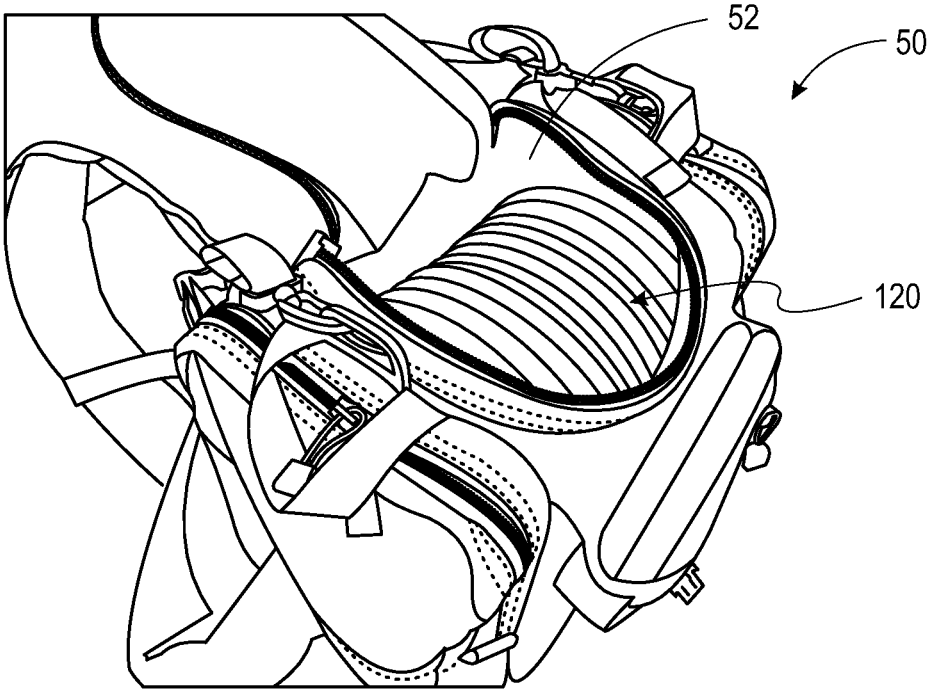
FIGS. 7A and 7B respectively illustrate perspective and top views of an example duffel bag defining an interior storage compartment for storing golf discs and including a golf disc retainer, in accordance with the present disclosure.
Figure 7B:
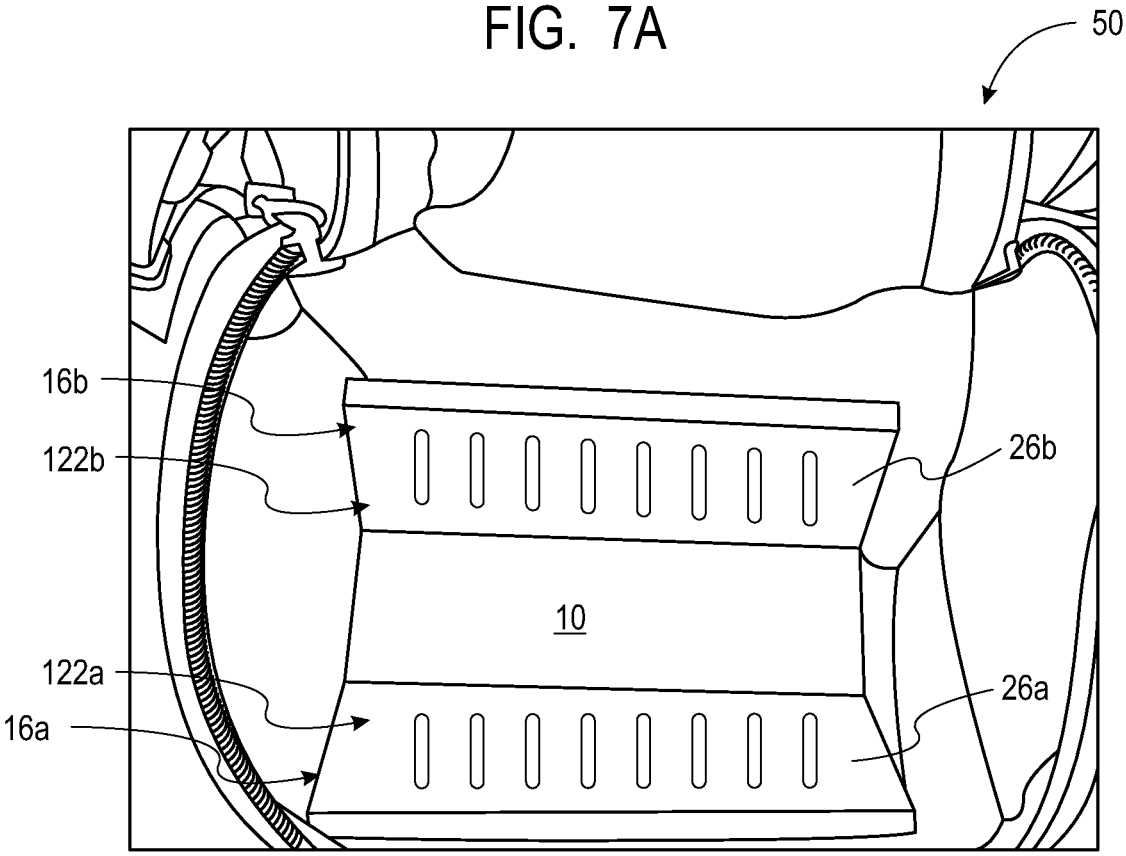

FIGS. 7A and 7B respectively illustrate perspective and top views of an example duffel bag 50 defining an interior storage compartment 52 for storing a plurality of golf discs 120 and including a golf disc retainer 10, in accordance with the present disclosure. FIG. 7A is a top perspective view illustrating a plurality of golf discs 120 stored within storage compartment 52 of duffel bag 50, and FIG. 7B is a top view illustrating the interior storage compartment 52 with the golf discs 120 removed and golf disc retainer 10 disposed therein. FIG. 7B respectively illustrate the series of indentations 122*a* and 122*b* in upper surfaces 26*a* and 26*b* of opposing side rails 16*a* and 16*b* formed by the compression of the elastic material of body 12 by the rims of the golf discs 120 when stored in duffel bag 50. By the elastic material of golf disc retainer 10 individually conforming about portions of the rims of golf discs 120 of varying diameters, both lateral and longitudinal movement of golf discs 120 within storage compartment 52 is prevented to thereby reduce and/or eliminate potential for damage to golf discs 120 during transport and storage. It is noted that over time, in the absence of the golf discs, the elastic material of body 12 will return to its original form.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A golf disc retainer for use with a storage container to store a plurality of golf discs of varying diameters and rim profiles, the golf disc retainer comprising:

a body extending in a longitudinal direction between opposing first and second ends and in a lateral direction between first and second sides, the body comprising an elastic material and including:

a first central base portion extending between the first and second ends; and a pair of opposing side rails extending from and along opposing longitudinal sides of the first central base portion between the first and second ends;

wherein upper surfaces of the first central base portion and the pair of opposing side rails together form an upper surface of the body and define a disc holding space extending in the longitudinal direction between the first and second ends and in the lateral direction between the first and second sides, the disc holding space to receive a plurality of golf discs which are to be oriented with a radial dimension of the golf discs extending in the lateral direction between the opposing side rails, to be positioned vertically to the upper surface of the body, and to be spaced apart from one another in the longitudinal direction with the elastic material of the upper surfaces of the first central base portion and the opposing side rails each to engage and conform about a circumferential rim of different respective arc segments of each golf disc, the disc-holding space being a wedge-shaped space having a narrower dimension at the upper surface of the first central base portion.

2. The golf disc retainer of claim 1, the elastic material comprising a closed cell foam material.

3. The golf disc retainer of claim 1, the elastic material of the upper surfaces of the first central base portion and opposing side rails to automatically conform to different diameters and different rim profiles of different golf discs.

4. The golf disc retainer of claim 1, the opposing side rails to center each golf disc along a longitudinally extending centerline of the body when engaged with the respective arc segment of the circumferential rim of the golf disc.

5. The golf disc retainer of claim 1, the upper surfaces of the opposing side rails each being angled upwardly and outwardly away from the upper surface of the first central base portion such that the disc-holding space is a wedge-shaped space having a narrower dimension at the upper surface of the first central base portion.

6. The golf disc retainer of claim 5, wherein the upper surfaces of the first central base portion and the opposing side rails are planar, with the upper surfaces of the opposing side rails each angled upwardly and away from the upper surface of first central base portion at a selected angle.

7. The golf disc retainer of claim 6, wherein a width of the first central base portion and the selected angle enable the wedge-shaped space to receive golf discs of varying diameters such that, for each golf disc, the upper surfaces of the first central base portion and opposing side rails each engage a different portion of a circumferential edge of the golf disc.

8. The golf disc retainer of claim 6, the selected angle being a range of angles and the width of the first central base portion being a range of widths.

9. The golf disc retainer of claim 6, the selected angle being 135 degrees.

10. The golf disc retainer of claim 1, the body being trimmable to adjust longitudinal and lateral dimensions of the body.

11. A storage container comprising:

opposing top and bottom sides;

opposing longitudinal sides extending between the top and bottom sides;

opposing lateral sides extending between the top and bottom sides and between the opposing longitudinal sides;

an interior storage compartment defined by the opposing top and bottom sides, the opposing longitudinal sides, and the opposing lateral sides, the interior storage compartment accessible via a cover on the top side which is operable between an open position and a closed positions; and a golf disc retainer disposed within the storage compartment, the golf disc retainer including:

a body extending in a longitudinal direction between opposing first and second ends and in a lateral direction between first and second sides, the body comprising an elastic material and including:

a first central base portion extending between the first and second ends; and a pair of opposing side rails extending from and along opposing longitudinal sides of the first central base portion between the first and second ends;

wherein upper surfaces of the first central base portion and the pair of opposing side rails together form an upper surface of the body and define a disc holding space extending in the longitudinal direction between the first and second ends and in the lateral direction between the first and second sides, the disc holding space to receive golf discs of varying diameters and rim profiles, the golf discs to be positioned vertically to the upper surface of the body and with a radial dimension oriented extending in the lateral direction between the opposing side rails with the elastic material of the upper surfaces of the first central base portion and the opposing side rails to engage and conform about different respective arc segments along a circumferential rim of each golf disc, the disc holding space being a wedge-shaped space having a narrower dimension at the upper surface of the first central base portion.

12. The storage container of claim 11, the storage container comprising a duffle bag made from a water-resistant fabric.

13. The storage container of claim 11, the elastic material of the upper surfaces of the first central base portion and opposing side rails to automatically conform to different diameters and different rim profiles of different golf discs.

14. The storage container of claim 11, the opposing side rails to center each golf disc along a longitudinally extending centerline of the body when engaged with the respective are segment of the circumferential rim of the golf disc.

15. The storage container of claim 11, the upper surfaces of the opposing side rails each being angled upwardly and outwardly away from the upper surface of the first central base portion such that the disc holding space comprises a wedge-shaped space having a narrower dimension at the upper surface of the first central base portion.

16. The storage container of claim 15, wherein the upper surfaces of the first central base portion and the opposing side rails are planar, with the upper surfaces of the opposing side rails each angled upwardly and away from the upper surface of first central base portion at a selected angle.

17. The storage container of claim 16, wherein a width of the first central base portion and the selected angle enable the wedge-shaped disc holding space to receive golf discs of varying diameters such that, for each golf disc, the upper surfaces of the first central base portion and opposing side rails each engage a different portion of a circumferential edge of the golf disc.

18. The storage container of claim 11, the body being trimmable to adjust longitudinal and lateral dimensions of the body.

* * * * *